United States Patent [19]

Wettstein

[11] Patent Number: 4,875,744

[45] Date of Patent: Oct. 24, 1989

[54] PARTS ORGANIZER

[76] Inventor: Ulrich Wettstein, 1281 Andersen Dr., San Rafael, Calif. 94901

[21] Appl. No.: 159,271

[22] Filed: Feb. 23, 1988

[51] Int. Cl.[4] ..... A47B 49/00

[52] U.S. Cl. ..... 312/266; 211/126

[58] Field of Search ..... 312/244, 266; 211/126; 206/45, 45.11

[56] References Cited

U.S. PATENT DOCUMENTS

| | | | |
|---|---|---|---|
| 1,090,592 | 3/1914 | Bethan | 206/45 |
| 2,518,779 | 8/1950 | Hennessey | 206/45 |
| 3,353,886 | 11/1967 | Tompkins | 312/244 |
| 3,594,057 | 7/1971 | Moore | 312/266 X |
| 4,646,921 | 3/1987 | Canter | 211/126 |

*Primary Examiner*—Joseph Falk

*Attorney, Agent, or Firm*—Larry D. Johnson

[57] ABSTRACT

A parts organizer provides a removable, reversible cover or lid to enable locking of the organizer in either the open or closed configurations. Curved trays of the organizer incorporate a structural foot portion that prevents inter-tray parts migration, and a specific center bin divider arrangement that prevents intra-tray parts migration.

2 Claims, 2 Drawing Sheets

PARTS ORGANIZER

BACKGROUND OF THE INVENTION

1. Field of the Invention

The present invention relates generally to organization and storage devices, and more specifically to parts organizers and portable work stations.

2. Description of the Prior Art

Applicant herein is the assignee and owner of Moore U.S. Pat. No. 3,594,057, which describes a container apparatus comprising a plurality of operatively connected interleavable receptacles or parts trays forming a closed unitary structure when in a closed position. That patent, while disclosing numerous interleavable arrangements, does not describe a workable, fully reversible folding structure, suitable for incorporation onto a carousel system. For example, the reversible structure in Moore requires an awkward, two-handled lid for transport in the open configuration. Furthermore, while some of the Moore devices do provide curved or "scooped" trays, those trays do not adequately prevent migration of the parts and components contained within them, resulting in potential disorganization and/or damage to the components.

SUMMARY OF THE INVENTION

The parts organizer of this invention provides a container comprising a system of panels, hinged at the planar intersection of their edges, which carry trays that interleave when the panels are folded inwardly together, so that the two remote, unhinged panel edges can connect to one another to form closed structure for storage or transportation, and includes a locking lid member to secure the open or closed configuration. When the lid member is removed and the parts organizer is opened, the hinging at the planar intersection enables the panels to pivot about their hinges past a position of coplanarity with one another to a position of recontact and reconnection of the remote panel edges, thereby displaying the trays outwardly from a common center, and the lid member is locked down again to secure this open configuration. Such an open configuration is especially conducive for incorporation of the parts organizer onto a revolving, carousel arrangement.

In order to fully utilize this reversible arrangement, it is necessary that the container's top or lid be lockable onto the top of the connected panels in either configuration. This invention provides a novel locking arrangement comprising a lid bearing a single, fixed handle and opposing lock portions that engage lips on the inside of one set of opposed panels for locking in the closed configuration, or lips on the outside of either set of opposed panels for locking in the open configuration.

The trays of the parts organizer include an upwardly concave curve or scoop angle to enable ease in picking up parts from the various trays and bins. Inter-tray parts migration (between adjacent trays) is prevented by inclusion of a structural baffle or "foot". This foot is placed at the center of the convex (outside) bottom curved surface of all but the lowest levels of the trays, so that the foot defines a cross sectional barrier area completely across the void otherwise created by the bottom curved surface. Thus, migration between trays is prevented just as if the trays were shaped in the traditional, but less efficient, rectangular shape.

Intra-tray parts migration (between the adjacent bins of a given tray, as determined by positioning of movable dividers within the tray) is prevented by appropriate width sizing of the central division or bin of all but the highest levels of the trays. By defining the width of the central bin a distance at least twice the radius of curvature of the scoop angle surface, the base of the next higher tray provides a barrier to migration between the bins of a given tray.

DETAILED DESCRIPTION OF A PREFERRED EMBODIMENT

Figure 1:
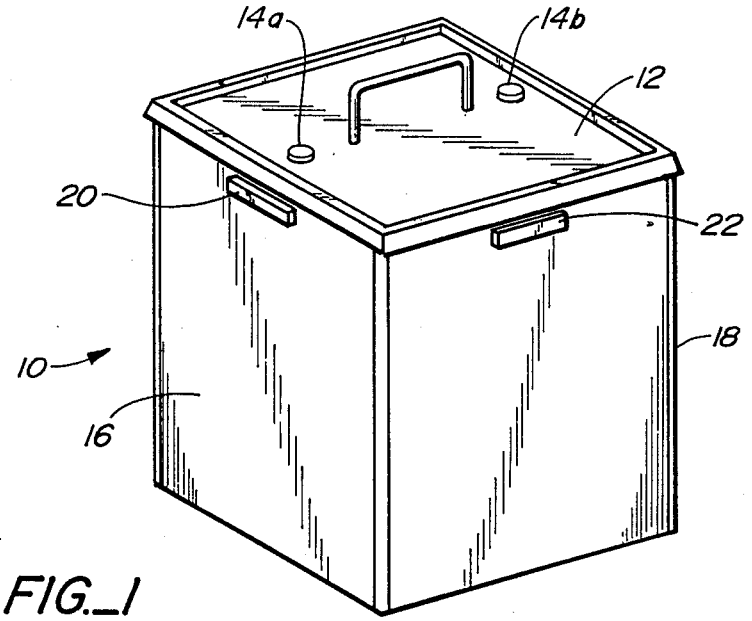
FIG. 1 is a perspective view of the parts organizer of this invention in its closed (storage) configuration, with the reversible lid locked in place on top of the organizer.

FIG. 1 is a perspective view of a parts organizer 10 in its closed configuration, with a reversible lid 12 locked in place on top. Lid 12 includes a pair of locking mechanisms 14*a, b* on opposite sides of the lid, which engage complementary inside lip portions (not visible in this view) on the inside surface of two opposed panels 16, 18. Outside lip portions 20, 22, etc. are used to engage the locking mechanisms when the organizer is in its open configuration (described infra in FIG. 2).

Figure 2:
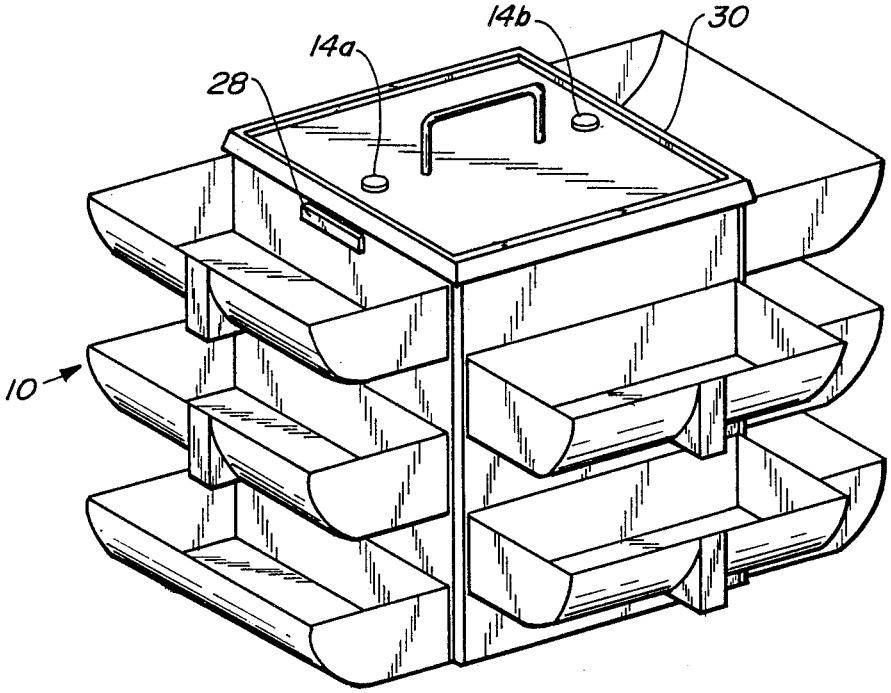
FIG. 2 is a perspective view of the parts organizer of this invention in its open (display) configuration, with the reversible lid again locked in place on top of the organizer.

FIG. 2 is a perspective view of the parts organizer 10 in its open configuration, with the reversible lid 12 again locked in place on top. Here, locking mechanisms 14*a, b* engage any two complementary, opposed outside lip portions 20, 22, etc. (not visible in this view, described supra in FIG. 1). Inside lip portions 28, 30, used to engage the locking mechanisms in the closed configuration (supra), are here disposed to the outside and visible.

Figure 3:
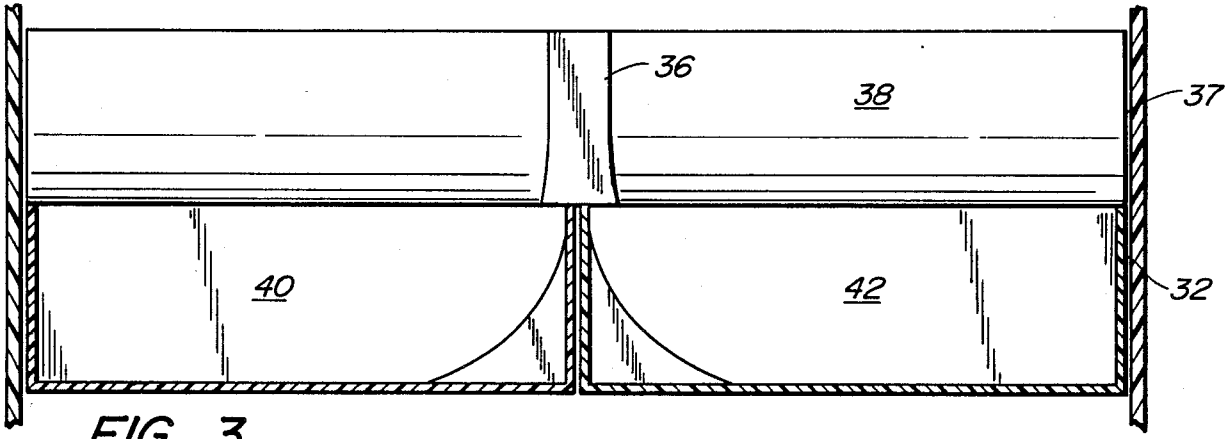
FIG. 3 is a side elevational view of two tray levels of a parts organizer in their interleaved configuration, illustrating the effect of the tray foot on preventing inter-tray parts migration.

FIG. 3 is a side elevational view of two tray levels 32, 34 of a parts organizer in their interleaved configuration, illustrating the effect of a tray foot 36 on preventing inter-tray migration. Tray foot 36, located at the center of the convex bottom surface of tray 38, provides a barrier to parts migration between trays 40 and 42.

Figure 4:
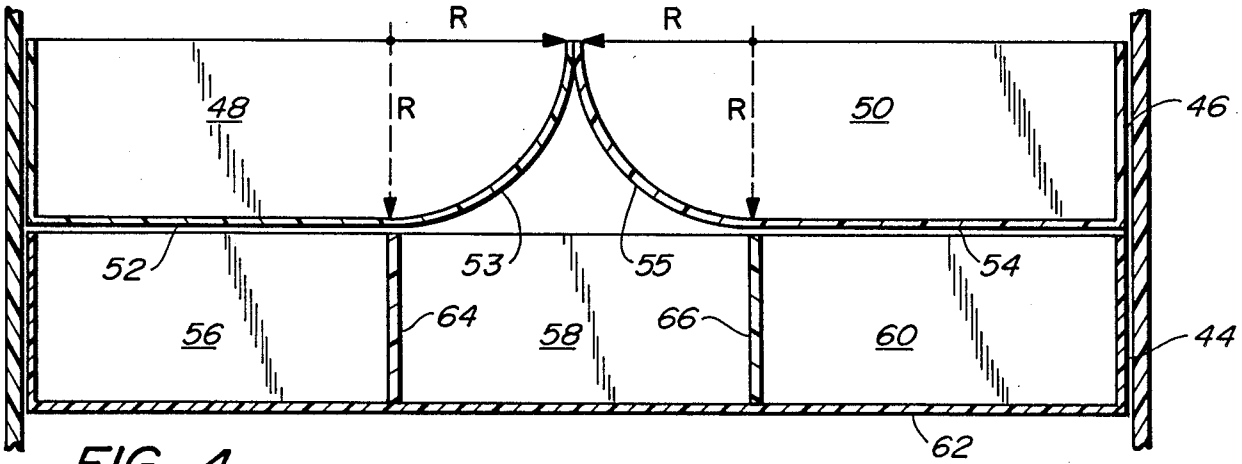
FIG. 4 is a side elevational view of two tray levels of the parts organizer in their interleaved configuration, illustrating the effect of appropriate placement of the center bin dividers on preventing intra-tray parts migration.

FIG. 4 is a side elevational view of two tray levels 44, 46 of a parts organizer in their interleaved configuration, illustrating the prevention of intra-tray migration by appropriate placement of the center bin dividers. Trays 48, 50 each have flat bottom surfaces 52, 54 and convex lower surfaces 53, 55, respectively, these convex surfaces being definable as a curve having a radius of curvature R, that would normally permit parts migration between the various bins 56, 58, 60 of tray 62. However, by positioning of bin dividers 64, 66 to define the width of center bin 58 as being greater than or equal to twice R, migration between the various bins is prevented by flat bottom surfaces 52, 54.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A parts organizer having a plurality of walls bearing vertically spaced trays, said walls operatively connected to interleaf said trays and form a closed unitary structure when in a closed position, said trays having an upwardly curved lower surface, the improvement comprising:

a structural foot portion located generally in the center of said trays and extending from said curved lower surface, wherein said foot portion provides a barrier to and prevents migration of parts between the trays interleaved immediately below said foot.

2. The parts organizer of claim 1 having a plurality of walls bearing vertically spaced trays, said walls operatively connected to interleaf said trays and form a closed unitary structure when in a closed position, said trays having an upwardly curved lower surface definable as having a radius of curvature R, at least some of said trays being subdivided by at least a center bin portion formed by divider members in said tray, wherein said center bin portion has a width greater than or equal to twice the value of the radius of curvature R.

* * * * *